US007285901B2

(12) United States Patent
Sasaki et al.

(10) Patent No.: US 7,285,901 B2
(45) Date of Patent: Oct. 23, 2007

(54) DISPLAY DEVICE HAVING A CONNECTING PORTION BETWEEN CATHODE LINE AND ELECTRON SOURCE

(75) Inventors: Susumu Sasaki, Chiba (JP); Yoshiyuki Kaneko, Hachioji (JP); Shigemi Hirasawa, Chiba (JP); Makoto Okai, Tokorozawa (JP); Hiroshi Kawasaki, Ooamishirasato (JP)

(73) Assignee: Hitachi Displays, Ltd., Mobara-Shi (JP)

( * ) Notice: Subject to any disclaimer, the term of this patent is extended or adjusted under 35 U.S.C. 154(b) by 90 days.

(21) Appl. No.: 10/781,695

(22) Filed: Feb. 20, 2004

(65) Prior Publication Data

US 2004/0164665 A1 Aug. 26, 2004

(30) Foreign Application Priority Data

Feb. 21, 2003 (JP) ..... 2003-044057

(51) Int. Cl.
*H01J 1/62* (2006.01)

(52) U.S. Cl. ..... 313/497; 313/495; 313/496

(58) Field of Classification Search ..... 313/495–497
See application file for complete search history.

(56) References Cited

U.S. PATENT DOCUMENTS

| | | | | |
|---|---|---|---|---|
| 5,772,485 | A * | 6/1998 | Jeng et al. | 445/24 |
| 6,239,547 | B1 | 5/2001 | Uemura et al. | |
| 6,664,727 | B2 | 12/2003 | Nakamoto | |
| 6,891,320 | B2 | 5/2005 | Nakamoto | |
| 6,930,748 | B2 * | 8/2005 | Moon | 349/158 |
| 2002/0151247 | A1 * | 10/2002 | Yanagisawa | 445/50 |

FOREIGN PATENT DOCUMENTS

| | | |
|---|---|---|
| JP | 11-162383 | 6/1999 |
| JP | 2000-36243 | 2/2000 |
| JP | 2000-90809 | 3/2000 |
| JP | 2000-251783 | 9/2000 |
| JP | 2001-283716 | 10/2001 |
| JP | 2002-157951 | 5/2002 |

OTHER PUBLICATIONS

"Large Size FED with Carbon Nanotube Emitter", Sashiro Uemura et al, SID 02 Digest (2002), pp. 1132-1135.

"Fully sealed high-brightness carbon-nanotube field-emission display", W.B. Choi et al, Appl. Phys. Lett. vol. 75, No. 20, (1999), pp. 3129-3131.

* cited by examiner

*Primary Examiner*—Joseph Williams
*Assistant Examiner*—Bumsuk Won
(74) *Attorney, Agent, or Firm*—Antonelli, Terry, Stout & Kraus, LLP.

(57) ABSTRACT

A display device includes a face substrate which has anodes and phosphors on an inner surface thereof, a back substrate which has cathode lines and electron sources formed on the cathode lines, a support body which is interposed between both substrates such that the support body surrounds a display region and forms a given inner space, and a sealing material which hermetically seals the support body and both substrates. To enable the display device to produce a high quality display and have a long lifetime while ensuring the conduction in a wide range between the cathode lines and the electron sources, the cathode lines are made of a material having a conductor and an insulator, and the composition of a connecting portion between the cathode line and the electron source is formed such that the conductor occupancy rate becomes equal to or more than the insulator occupancy rate.

15 Claims, 8 Drawing Sheets

DISPLAY DEVICE HAVING A CONNECTING PORTION BETWEEN CATHODE LINE AND ELECTRON SOURCE

BACKGROUND OF THE INVENTION

The present invention relates to a display device which utilizes an emission of electrons into a vacuum space, which is formed between a face substrate and a back substrate to produce a display; and, more particularly, the invention relates to a display device of the type described which exhibits excellent characteristics in emitting electrons from an electron source.

As a display device which exhibits a high brightness and high definition, color cathode ray tubes have been popularly used conventionally. However, along with the recent request for the provision of higher quality images in information processing equipment or television broadcasting, the demand for planar displays (panel displays) which are light in weight and require a small space, while exhibiting a high brightness and high definition, has been increasing.

As typical examples, liquid crystal display devices, plasma display devices and the like have been put into practice. Further, as display devices which can realize higher brightness, it is expected that various kinds of panel-type display devices, including a display device, which utilizes an emission of electrons from electron sources into a vacuum and is referred to as an electron emission type display device or a field emission type display device, and an organic EL display, which is characterized by low power consumption, will be commercialized.

Among such panel type display devices, such as the above-mentioned field emission type display device, a display device having an electron emission structure, which was proposed by C. A. Spindt et al, a display device having an electron emission structure of a metal-insulator-metal (MIM) type, a display device having an electron emission structure which utilizes an electron emission phenomenon based on a quantum theory tunneling effect (also referred to as "surface conduction type electron source), and a display device which utilizes an electron emission phenomenon having a diamond film, a graphite film and carbon nanotubes and the like, have been known.

Among these panel type display devices, the field emission type display device is formed by laminating and sealing a front panel, which has an anode electrode and a fluorescent material layer formed on an inner surface thereof, and a back panel, which has electron emission type cathodes and grid electrodes, which constitute a control electrode, formed on an inner surface thereof, so that a distance of not less than 0.5 mm, for example, is formed therebetween, whereby a sealed space is formed between both panels and the sealed space is evacuated to a pressure lower than the ambient atmospheric pressure or to a vacuum.

Recently, the use of carbon nanotubes (CNT) as a field emission type electron source, which constitutes the cathodes of this type of planar display, has been studied. Carbon nanotubes are extremely thin needle-like carbon compound elements (strictly speaking, a so-called graphene sheet in which carbon atoms are coupled in a hexagonal shape is formed in a cylindrical shape). A carbon nanotube assembly, which is formed by collecting a large number of carbon nanotubes, is fixed to a cathode electrode. By applying an electric field to the cathode electrode having the carbon nanotubes, it is possible to emit electrons with a high density from the carbon nanotubes with a high efficiency, whereby it is possible to constitute a flat panel display which is capable of displaying various images of high brightness by exciting a phosphor with these electrons.

FIG. 13 is a schematic diagram showing the basic structure of a field emission type display device. CNT denotes the carbon nanotubes formed on a cathode (cathode electrode) K, A indicates an anode (anode electrode), and a phosphor PH is formed on an inner surface of the anode A. A grid electrode G, which controls the emission of electrons, is formed in the vicinity of the cathode K, and a voltage Vs is applied between the cathode K and the grid electrode G so that electrons are emitted from the carbon nanotubes CNT. By applying a high voltage Eb between the cathode K and the anode A, the electrons e emitted from the carbon nanotubes CNT are accelerated and the phosphor PH is excited whereby light L having a color which is dependent on the composition of the phosphor PH is irradiated. Then, by controlling the quantity of electrons which are emitted in response to the modulation voltage Vs that is supplied to the grid electrode G formed in the vicinity of the cathode K, for example, the brightness of the light L can be controlled.

FIG. 14 is a schematic cross-sectional view showing a constitutional example of the field emission type display. In this field emission type display (FED), a back substrate 1 which is formed of a glass plate and a face substrate 2 which is also formed of a glass plate are laminated to each other by way of a frame-like support body 3 which is interposed between both substrates 1, 2. The support plate 3 has a height of approximately 1 mm, for example, and surrounds a display region so as to maintain a given distance between both substrates 1, 2. Further, the inside hermetic space between the substrates is evacuated and sealed. Cathode lines 13, insulation layers 14 and grid electrodes 15 are formed on an inner surface of the back substrate 1, while anode electrodes 11 and phosphors 12 are formed on an inner surface of the face substrate 2. Carbon nanotubes of electron sources which are not shown in the drawing are provided to the cathode lines 13.

FIG. 15 is a schematic plan view as seen from the back substrate 1 side of the field emission type display shown in FIG. 14. In the inside of the effective display region AR on the inner surface of the face substrate 2, phosphors R, G, B of three colors are arranged. In this example, respective pixels are defined by partitions 16. In a monochromic display, all phosphors are formed in the same color.

With respect to the above-mentioned display which uses carbon nanotubes, various publications, such as non-patent literature 1 ("Large Size FED with Carbon Nanotube Emitter" Sashiro Uemura et al., SID 02 DIGEST (2002), pp. 1132-1135), non-patent literature 2 (Fully sealed, high-brightness carbon-nanotube field-emission display"., W. B. Choi et al., Appl. phys. Lett., VOL. 75, NO. 20, (1999), pp. 3129-3131) and the like are known. A field emission type display disclosed in these publications is configured such that a carbon nanotube paste, which is obtained by forming carbon nanotube powder into a paste, or a carbon nanotube-metal mixture paste, which is formed by mixing carbon nanotube powder and metal powder, is printed on a glass substrate, and gate electrodes which constitute pull-out electrodes (or control electrodes) and a fluorescent surface which emits light upon incidence of the pulled-out light are arranged on an upper surface of the printed paste.

Further, as examples of cathodes which constitute electron emitting portions in this type of panel display, a technique in which the electron emitting portions are constituted of carbon nanotubes formed of cylindrical graphite layers is disclosed in patent literature 1 (Japanese Unexamined Patent Publication Hei11(1999)-162383. Further, patent literature 2 (Japanese Unexamined Patent Publication 2000-36243) discloses a method of forming an electron emission portion in which a paste which is formed by mixing bundles, each of which is a mass of carbon nanotubes into a tacky solution having conductivity is formed into a pattern, and laser beams are irradiated to the pattern thus making the carbon nanotubes emit electrons in a state in which the carbon nanotubes are projected from a surface of the pattern.

Further, patent literature 3 (Japanese Unexamined Patent Publication 2000-90809) discloses a technique in which field emission cathodes are formed by causing a bundle of carbon nanotubes to adhere to a substrate using a conductive resin. Still further, patent literature 4 (Japanese Unexamined Patent Publication 2000-251783) discloses an example in which a resistance layer formed of a ruthenium oxide mixture film or an a-Si thin film is applied to a cathode electrode formed of a strip-like conductor, and an emitter made of a field emission material, such as carbon nanotubes, is formed on the resistance layer. Further, patent literature 5 (Japanese Unexamined Patent Publication 2001-283716), patent literature 6 (Japanese Unexamined Patent Publication 2002-157951) and the like disclose a technique in which a portion of carbon nanotubes is embedded into a metal plating layer formed on a support substrate and projecting portions are used as an emitter.

SUMMARY OF THE INVENTION

The above-mentioned electron emission type display device is of a type in which a display is produced by causing electrons emitted from electron sources to pass through apertures formed in the control electrodes and impinge on the phosphors which constitute the anodes, so as to excite the phosphors and generate light. This display device provides an excellent structure which enables provides for a light-weight and space-saving planar display which has excellent characteristics, such as high brightness and high definition. However, in spite of such an excellent constitution, the display device still has problems to be solved which will be described later. That is, in a flat panel display such as the above-mentioned FED or the like, there are positions where the electron source does not perform electron emission in spots on some portions of a surface of an electron source, and, hence, the electron emission is performed in a mottled pattern. Accordingly, there arises a drawback in that it is difficult to always obtain a uniform electron emission from the whole surface of the electron source. There also arises a drawback in that the electron emission quantity per se becomes insufficient. When the electron emission quantity becomes insufficient and non-uniform, the brightness of a video screen also becomes insufficient, and, hence, it is difficult to ensure a desirable display quality. Accordingly, there arise drawbacks in that it is difficult to obtain a high quality display and in that the exhaustion of the electron source is accelerated, thus impeding the acquisition of a long lifetime of use. These drawbacks constitute problems to be solved by the present invention.

Accordingly, it is an object of the present invention to provide a display device that is capable of producing a desired high-quality display and which has a long lifetime of use by solving the above-mentioned various drawbacks.

To achieve the above-mentioned object, the representative constitution of the present invention is characterized by an improvement of the structure which connects cathode lines and electron sources. Hereinafter, representative constitutions of the display device of the present invention will be described.

That is, the display device according to the present invention comprises a face substrate which has anodes and phosphors formed on an inner surface thereof, a plurality of cathode lines which extend in one direction and are arranged in parallel in another direction which crosses the one direction and which have electron sources thereon, control electrodes which face the cathode lines in a display region and have electron passing apertures for allowing electrons from the electron sources to pass through the electron passing apertures to the face substrate side, a back substrate which has the control electrodes and the cathode lines formed on an inner surface thereof and faces the face substrate in an opposed manner with a given distance therebetween, a support body which is interposed between the face substrate and the back substrate in a state such that the support body surrounds the display region and maintains the given distance therebetween, and a sealing material which hermetically seals end faces of the support body and the face substrate and the back substrate, respectively, wherein a connecting portion of the cathode line with the electron source has a composition which includes a conductor and an insulator, and the occupancy rate of the conductor in the composition is set to be equal to or more than the occupancy rate of the insulator in the composition.

Further, the display device according to the present invention may be constituted such that the occupancy rate of the insulator is less than 50% and a surface of the back substrate in the vicinity of the cathode lines exhibits an uneven shape.

That is, the display device according to the present invention comprises a face substrate which has anodes and phosphors formed on an inner surface thereof, a plurality of cathode lines which extend in one direction and are arranged in parallel in another direction which crosses the one direction and which have electron sources thereon, control electrodes which face the cathode lines in a display region and have electron passing apertures for allowing electrons from the electron sources to pass through the electron passing apertures to the face substrate side, a back substrate which has the control electrodes and the cathode lines formed on an inner surface thereof and faces the face substrate in an opposed manner with a given distance therebetween, a support body which is interposed between the face substrate and the back substrate in a state such that the support body surrounds the display region and maintains a given distance therebetween, and a sealing material which hermetically seals end faces of the support body and the face substrate and the back substrate, respectively, wherein a layer having a high conductor occupancy rate is interposed in a connecting portion between the cathode line and the electron source.

Further, the display device according to the present invention may be constituted such that the layer in which the conductor has a high occupancy rate is a silver particle layer or a gold particle layer.

Due to the above-mentioned constitutions, it is possible to provide a display device which can produce a high quality display and can have a long lifetime of use.

Here, the present invention is not limited to the above-mentioned constitution and to the constitution of embodiments to be described later, and various modifications can be made without departing from the technical concept of the present invention.

DESCRIPTION OF THE PREFERRED EMBODIMENTS

Preferred embodiments of the present invention will be explained in detail hereinafter in conjunction with the drawings.

Figure 1:
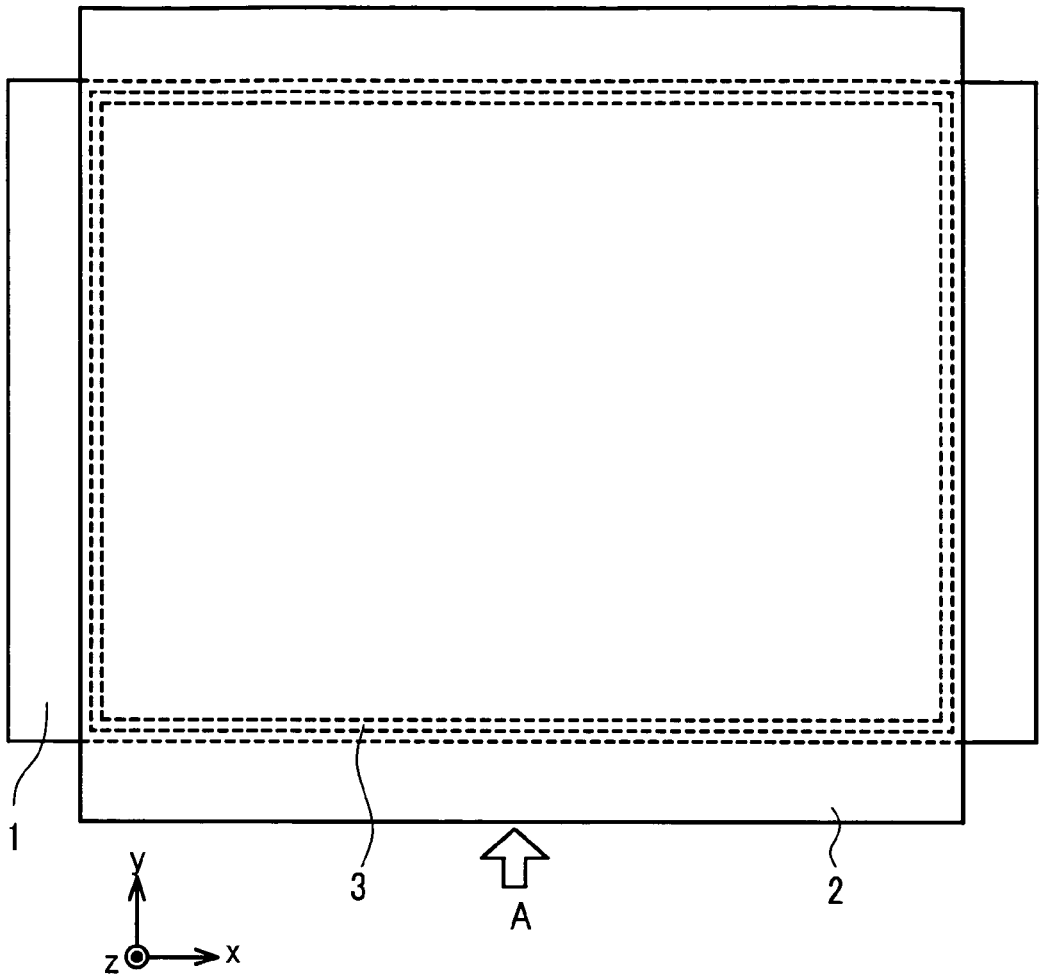
FIG. 1(*a*) is a schematic plan view of one embodiment of a display device according to the present invention, as viewed from a face substrate side, and FIG. 1(*b*) is a schematic side view as viewed from the direction indicated by an arrow A in FIG. 1(*a*)
Figure 1:
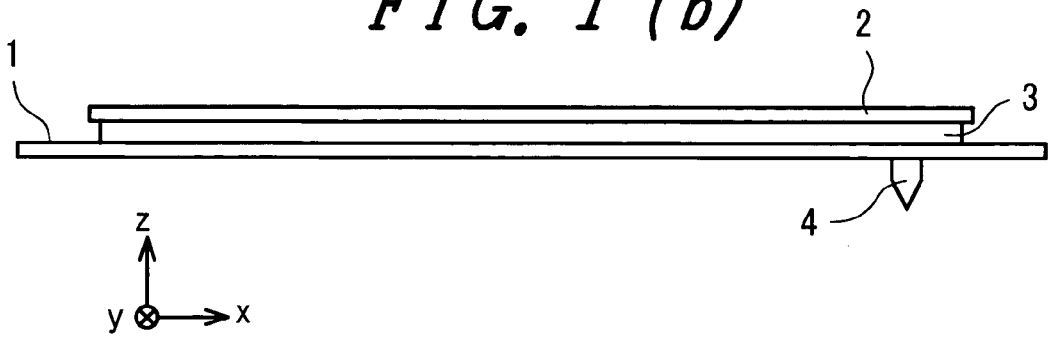
Figure 2:
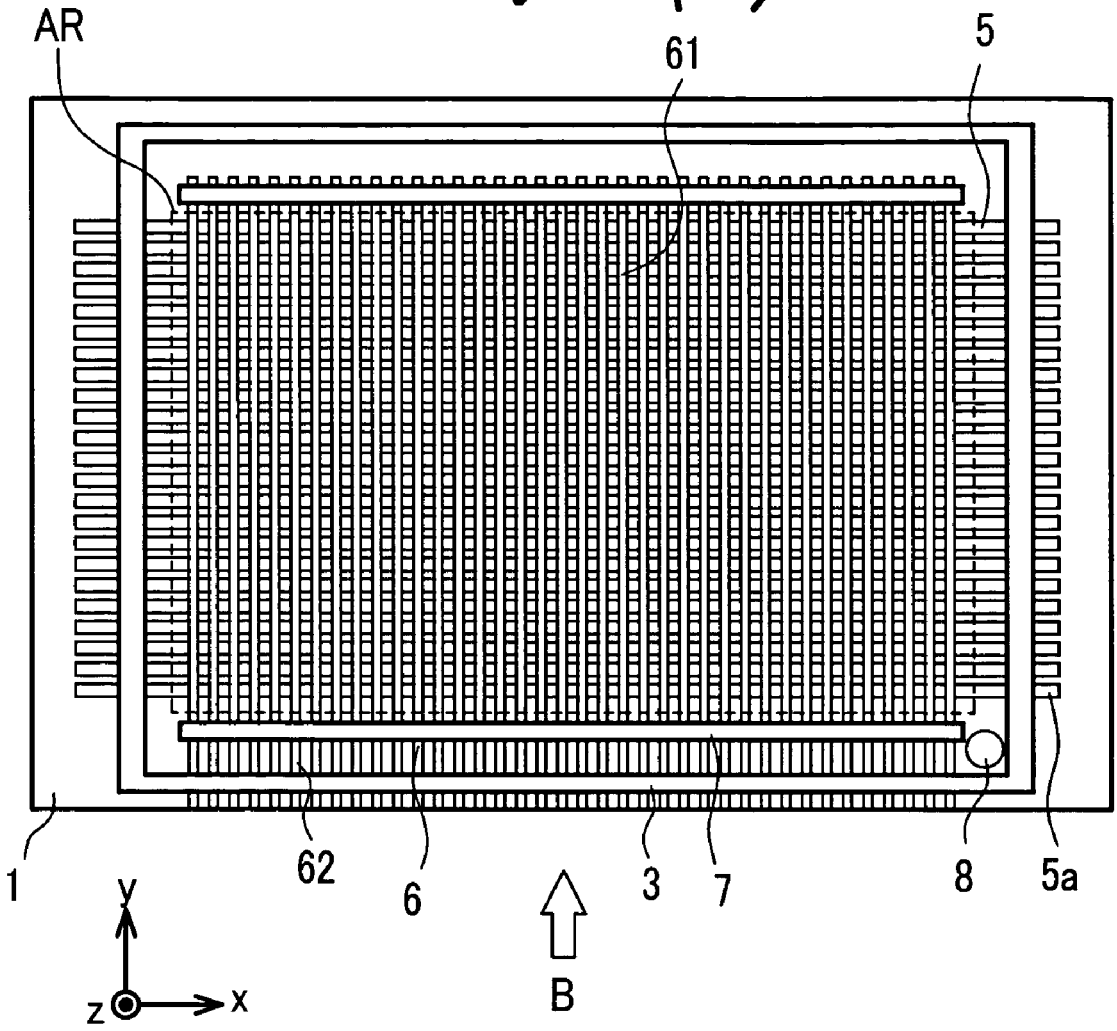
FIG. 2(*a*) is a schematic plan view of the back substrate of the display device of FIG. 1(*a*) as viewed from above in the z direction, and FIG. 2(*b*) is a schematic side view as viewed from the direction indicated by an arrow B in FIG. 2(*a*)
Figure 2:
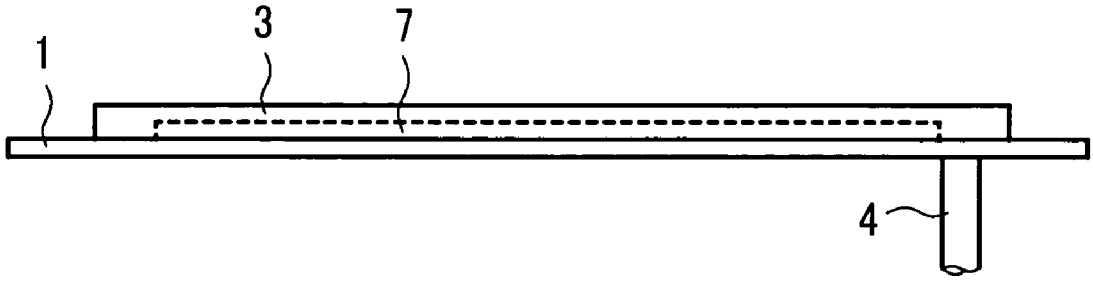

In FIG. 1(*a*) and FIG. 1(*b*) as well as in FIG. 2(*a*) and FIG. 2(*b*), numeral 1 indicates a back substrate, numeral 2 indicates a face substrate, numeral 3 indicates a support body which also functions as an outer frame, and numeral 4 indicates an exhaust pipe (in a sealed state). Further, numeral 5 indicates cathode lines, numeral 6 indicates control electrodes, numeral 7 indicates electrode pressing members, and numeral 8 indicates an exhaust port, wherein the exhaust port 8 is formed in the back substrate 1 and is in communication with the exhaust pipe 4. Here, the exhaust pipe 4 is shown in a pre-sealed state in FIG. 1(*b*). The back substrate 1 is constituted by an insulation substrate which is preferably made of glass or ceramic such as alumina in the same manner as the face substrate 2 and has a film thickness of several mm, for example, 3 mm. The face substrate 2 and the back substrate 1 are stacked in the z direction. Here, the z direction indicates a direction which is orthogonal to the substrate surfaces of the back substrate 1 and the face substrate 2. On an inner surface of the back substrate 1, a plurality of cathode lines 5, having a constitution to be described later, extend in one direction (the x direction) and are arranged in parallel in another direction (the y direction). End portions of the cathode lines 5 are pulled out to the outside of the support body 3 as lead lines 5*a* of the cathode lines 5.

Above the cathode lines 5, there are the control electrodes 6, which are formed of a plurality of strip-like electrode elements 61, which strip-like electrode elements 61 are insulated from the cathode lines 5, extend in the y direction and are arranged in parallel in the x direction. Further, at the outer periphery of the gap defined between opposing surfaces of the back substrate 1 and the face substrate 2, the support body 3 is interposed. A sealing material is interposed between both end surfaces of the support body 3 and both substrates 1, 2 thus hermetically sealing the inside space defined by the support body 3 and both substrates 1, 2. Then, by evacuating the inside through the exhaust pipe 4, a given degree of vacuum is created in the inside space. The above-mentioned hermetic sealing is performed heating the inside space in a nitrogen atmosphere, for example, at a temperature of approximately 430° C., for example, and thereafter, the inside space is evacuated while being heated at a temperature of approximately 350° C., for example, thus sealing the inside space in a vacuum state.

Here, as the sealing material, for example, a glass material which has the composition of 75 to 80 wt % of PbO, approximately 10 wt % of $B_2O_3$ and 10 to 15 wt % of balance and contains amorphous type frit glass can be preferably used.

Further, unit pixels are formed on crossing portions of the cathode lines 5 and the control electrodes 6 in a matrix array, and the above-mentioned display region is formed of these pixels arranged in the matrix array. In general, three unit pixels form a group and constitute a color pixel consisting of red (R), green (G) and blue (B) colors.

Here, the control electrodes 6 are constituted by arranging a large number of strip-like electrode elements (metal ribbons) 61 having electron passing holes in parallel and have been proposed by the inventors of the present invention in the course of development arriving at the present invention.

The control electrodes 6 may be manufactured in a separate step as separate parts. The control electrodes 6 are arranged above (the face substrate 2 side) and close to the cathode lines 5, which have electron sources thereon, and, at the same time, portions thereof in the vicinity of both end portions thereof fixed to the back substrate 1 by the electrode pressing members 7 or the like, which are arranged outside a display region AR and inside the support body 3 and are made of an insulator, such as a glass material or the like. Further, the lead lines 62 are connected to the control electrodes 6 in the vicinity of the electrode pressing members 7 or in the vicinity of the support body 3, and these lead lines 62 extend out to an outer periphery of the display device and are connected to external circuits. The lead lines 62 may be formed by directly extending the strip-like electrode elements 61.

Using the control electrodes 6 having such a constitution as, compared to the structure in which control electrodes are formed by forming metal thin films on an insulation layer by vapor deposition, it is easy to set a uniform gap between the control electrodes and the cathode lines 5, and, hence, the control characteristics of respective pixels can be made uniform over the whole area of the display region, thus enabling the acquisition of a high quality video display.

Figure 3:
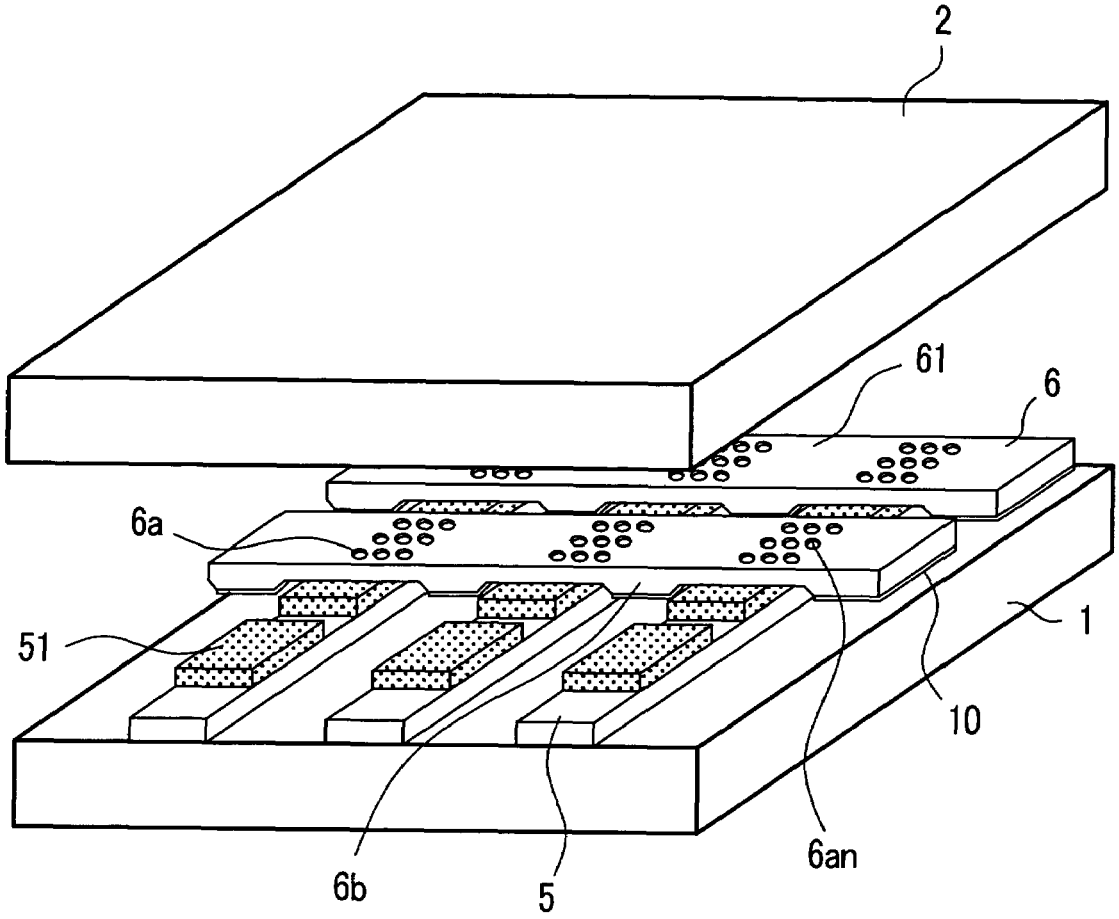
FIG. 3 is a schematic perspective view showing an essential part of one embodiment of the display device according to the present invention shown in FIG. 1(*a*) and FIG. 1(*b*), as well as in FIG. 2(*a*) and FIG. 2(*b*), in an enlarged manner.
Figure 4:
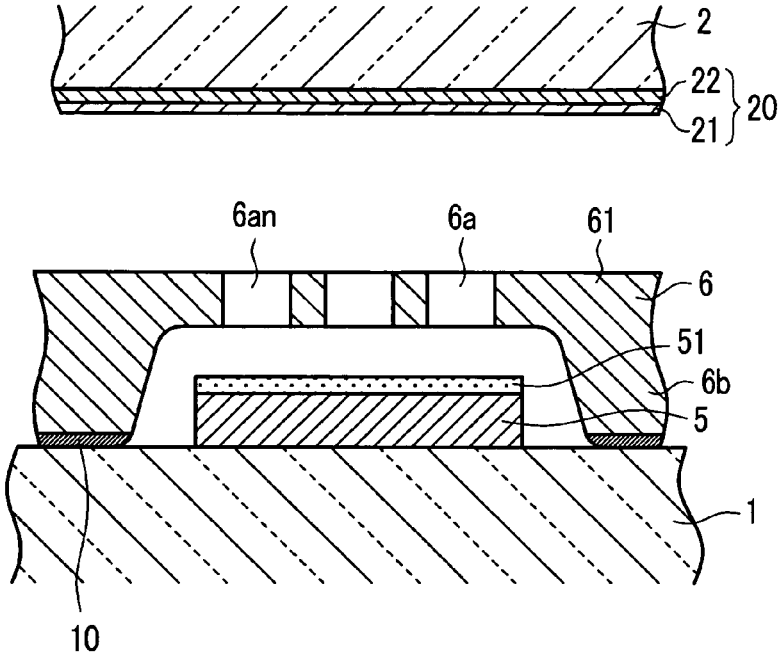
FIG. 4 is a schematic cross-sectional view showing an essential part in FIG. 3.

FIG. 3 is a schematic perspective view showing an essential part of a field emission type display device which represents one embodiment of the display device according to the present invention, as shown in FIG. 1(*a*) and FIG. 1(*b*), as well as in FIG. 2(*a*) and FIG. 2(*b*), in an enlarged form, while FIG. 4 is a schematic cross-sectional view showing an essential part in FIG. 3. In FIG. 3 and FIG. 4, the formation of the cathode lines 5 may be effected either by a method which forms the cathode lines 5 by a vacuum thin film forming process, as represented by a vapor deposition method or a sputtering method, or by a thick wall printing process in which the cathode lines 5 by printing and baking a metal paste having a constitution which contains approximately several % to 20% of metal particles and a low-melting-point glass component. In this embodiment, the latter method is adopted.

That is, the cathode lines 5 are formed by printing a silver paste having a large thickness and, thereafter, by baking the printed silver paste at a temperature of 60° C., for example. Here, the silver paste is formed by mixing a low melting-point glass which exhibits an insulation property into conductive silver particles having a particle size of several μm, that is, approximately 1 to 5 μm, for example.

On the other hand, on the cathode lines 5, electron sources 51, which are formed of a diamond film, a graphite film, carbon nanotubes or the like, are formed at a given pitch. The details of the connection between the electron sources 51 and the cathode lines 5 will be explained in conjunction with FIG. 5 and succeeding drawings later.

Further, above the cathode lines 5 (the face substrate 2 side) are the control electrodes 6, which are constituted by a large number of strip-like electrode elements 61 having a plurality of electron passing apertures 6*a* which are arranged close to the cathode lines 5. For example, the control electrodes 6 are arranged close to the cathode lines 5 such that the gap between the electron sources 51 and the electron passing apertures 6*a* is set to approximately 0.1 mm or less. The cathode lines 5 and the control electrodes 6 face each other in an opposed manner at least over the whole area of the display region AR and electrical insulation is ensured between the cathode lines 5 and the control electrodes 6. Further, numeral 6*b* indicates projecting portions formed on the strip-like electrode element 61.

In this embodiment, each electron passing aperture 6*a* formed in the strip-like electrode element 61 is constituted of a large number of small electron passing apertures 6*an*. Further, the distal ends of the projecting portions 6*b* are formed of a sealing material 10, which is of a type that is substantially the same as the sealing material used for the previously-mentioned hermetic sealing between the support body 3 and both substrates 1, 2, and they are fixed to an inner surface of the back substrate 1. This fixing can be performed in a nitrogen atmosphere, for example, at a temperature of 450° C., for example.

The control electrodes 6 in this embodiment, which are constituted by arranging a large number of strip-like electrode elements 61 in parallel, are electrodes which have been proposed by the inventors of the present invention in the course of development arriving at the present invention. Here, these strip-like electrode terminals 61 are formed of an iron-based stainless steel material or an iron material and have a plate thickness of approximately 0.025 mm to 0.150 mm, for example. The control electrodes 6 are constituted by extending the strip-like electrode elements 61 in the y direction and arranging the strip-like electrode elements 61 in parallel in the x direction.

Further, at the crossing portions of the cathode lines 5 and the plate-like control electrodes 6, the electron sources 51 and the electron passing apertures 6*a* are arranged to face each other in an opposed manner.

In such a constitution, electrons emitted from the electron sources 51 that are arranged on the cathode lines 5 are subjected to control in the electron passing apertures 6*a* of the control electrodes 6, to which a grid voltage of approximately 100V is applied, and, thereafter, they pass through the electron passing apertures 6*a*. Then, the electrons advance toward a phosphor screen 20 to which an anode voltage of several KV to 10 and some KV is applied, and they penetrate a metal back film 21 (anode) which constitutes the phosphor screen 20 that is arranged on the face substrate 2 and impinge on a phosphor film 22, thus making the phosphor film 22 emit light, whereby a desired display is performed on a video image screen. Here, although not shown in the drawing, the phosphor screen 20 includes black matrix films (BM), and, hence, the phosphor screen 20 of this embodiment has a constitution which is substantially the same as the constitution of the phosphor screen of a conventional color cathode ray tube.

Figure 5:
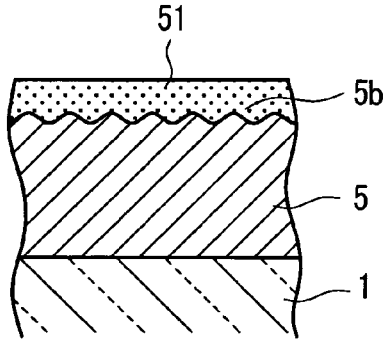
FIG. 5 is a schematic cross-sectional view showing an essential part in FIG. 4 in an enlarged manner.

Next, the connecting structure between the cathode lines 5 and the electron sources 51, which are formed on the cathode lines 5, will be explained in conjunction with FIG. 5. That is, FIG. 5 is a schematic cross-sectional view showing an essential part of the cathode line, the electron source and the like shown in FIG. 4 in an enlarged manner. The cathode line 5 has a composition in which the property of a connecting portion 5*b* connected with the electron source 51 is set such that the conductor occupancy rate becomes equal to or more than the insulator occupancy rate.

To explain this composition of the cathode line 5 in more detail, as mentioned previously, the cathode line 5 is formed of silver paste, which is produced by mixing low melting-point glass, which exhibits an insulation property, into conductive silver particles having a particle size of several μm, that is, approximately 1 to 5 μm, for example. This silver paste is printed and baked on the back substrate 1 by a thick film printing process, wherein a thick film is formed by baking the silver paste at a temperature of 600° C., for example. Then, a surface of the thick film which constitutes a contact portion 5*b* with the electron source 51 is etched by chemical etching so as to remove portions or the whole of the glass component in the surface, whereby the conductor occupancy rate of the connecting portion 5*b* becomes equal to or more than the insulator occupancy rate thereof. A carbon nanotube paste is printed on a surface of the connecting portion 5*b* having such a property, and the paste is baked at a temperature of 590° C. in a vacuum, for example, thus forming the electron source 51.

In this embodiment, as the carbon nanotube paste, a paste which is produced by dispersing single-wall carbon nanotubes into ethylene cellulose and terpineol is used. Although the explanation of this embodiment is directed to a case which uses the single-wall carbon nanotubes, multi-wall carbon nanotubes or carbon nanofibers may be used in place of the single-wall carbon nanotubes. Further, besides the above-mentioned materials, diamond, diamond-like carbon, graphite, amorphous carbon or the like can be used. Still further, it is needless to say that a mixture of these materials can be also used. It is also needless to say that the electron source may contain metal particles, such as silver particles or the like, or a quantity of insulating material which does not impede the emission of electrons.

By adopting the constitution shown in FIG. 5, in the connecting portion 5*b*, as described above, the glass component between the silver particles is removed and the conductor is exposed over substantially the whole surface. Accordingly, the conduction between the cathode lines and the electron sources is enhanced such that the conduction is carried out over substantially the whole surface of the connecting portions, thus enabling the electron emission from substantially the whole surface of the electron sources, and, at the same time, it is possible to obtain a uniform emission quantity for a long period of time.

In the constitution shown in FIG. 5, the phosphor screen 20 is arranged so as to be spaced away from the electron sources 51 by 300 μm in a vacuum and the connection structure is operated by applying a voltage of approximately 900V to the phosphor screen 20. As a result of such operation, a substantially uniform light emission is obtained, and the non-uniform light emission in a mottled pattern is not observed.

Here, in the cathode line 5, the glass component is removed only from the connecting portion which contributes to the connection of the cathode line 5 with the electron source 51 and a desired quantity of glass component is mixed into a portion of the cathode line 5 that is disposed below the connecting portion; and, hence, the film per se holds a sufficient rigidity, and there is no possibility that the adhesive strength between the cathode line 5 and the back substrate 1 is lowered.

When the display device, on which the back substrate 1 having the connecting structure shown in FIG. 5 is mounted, is operated with an anode voltage of 7 kV and a grid (control electrode) voltage of 100V (60 Hz driving), all pixels emit a substantially uniform light and exhibit a sufficient brightness necessary to produce a display, and, hence, it is confirmed that the display device can be practically used.

Figure 6:
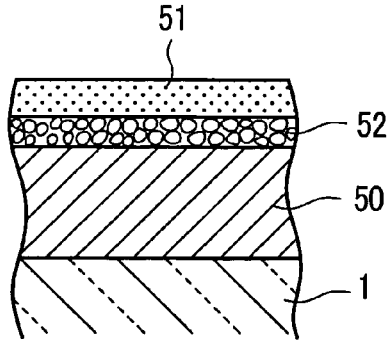
FIG. 6 is a schematic cross-sectional view of another embodiment of the display device according to the present invention and corresponds to FIG. 5.

FIG. 6 is a schematic cross-sectional view showing an essential part of another embodiment of the display device according to the present invention in an enlarged form and it corresponds to FIG. 5. In FIG. 6, numeral 50 indicates a cathode line and numeral 52 indicates a conductor layer. The conductor layer 52 is obtained by applying a paste in which fine silver particles having a particle size of approximately 10 nm, for example, are dispersed to the cathode line 50, and by baking the applied paste at a temperature of 350° C., for example. Thus, the conductor layer 52 is formed of only fine silver particles. The use of the fine silver particles is characterized by the fact that the fine silver particles can be sintered by baking at a temperature of at least approximately 300° C., for example, even when a glass component is not contained in the paste. The silver particle layer may be replaced by a fine particle paste which is formed by using another metal, such as a fine particle paste made of gold, for example. Further, in the same manner as described with reference to FIG. 5, a carbon nanotube paste is applied to a surface of the conductor layer 52, and the paste is baked at a temperature of 590° C. in a vacuum, thus forming an electron source 51.

On the other hand, the cathode line 50 is formed of the same material as the above-mentioned cathode line 5 and is formed by printing and baking the material. However, the chemical etching treatment is not performed. By interposing the above-mentioned conductor layer 52 between the cathode line 50 and the electron source 51, substantially the whole surface of the electron source 51 at the cathode line 50 side is brought into contact with the conductor. Accordingly, it is confirmed that electron emission can be realized from substantially the whole surface of the electron source 51, and, at the same time, a uniform emission quantity of electrons can be obtained for a long time.

That is, in the constitution shown in FIG. 6, the phosphor screen 20 is arranged so as to be spaced away from the electron sources 51 by 300 μm in a vacuum and the connection structure is operated by applying a voltage of approximately 900V to the phosphor screen 20. As a result of such an operation, a substantially uniform light emission is obtained, and a non-uniform light emission in a mottled pattern is not observed; and, hence, the advantageous effect of the present invention is attained.

On the other hand, the above-mentioned glass component exists in a connecting portion between the conductor layer 52 and the cathode line 50. However, provided that the conduction between them is ensured at some portions of the connecting portion, the function can be achieved, and, hence, the interposition of the glass component does not cause any problem. Further, the cathode line 50 per se is formed of silver paste, which mixes low melting-point glass which exhibits an insulating property into the conductive silver particles as mentioned previously. Accordingly, compared to a case in which both films formed of the cathode line 50 and the conductor layer 52 are integrally formed of only the above-mentioned fine silver particles, it is possible to manufacture the connecting structure at a low cost, and, at the same time, there is no possibility that the adhesive strength between the cathode line 50 and the back substrate 1 is lowered.

Here, it is needless to say that another conductor layer may be interposed between the cathode line 50 and the conductor layer 52 or between the cathode line 50 and the back substrate 1.

Further, although an explanation has been made with respect to a case in which the cathode line is formed of silver paste, it is needless to say that the cathode line may be formed by using other metal particles, such as gold particles, nickel particles or the like, for example. Further, although a non-photosensitive paste is used as the silver paste, a photosensitive paste may be used as the silver paste. Still further, it is needless to say that the present invention is also applicable to a constitution in which the cathode line and the electron sources are produced by patterning using a photolithography process.

Figure 7:
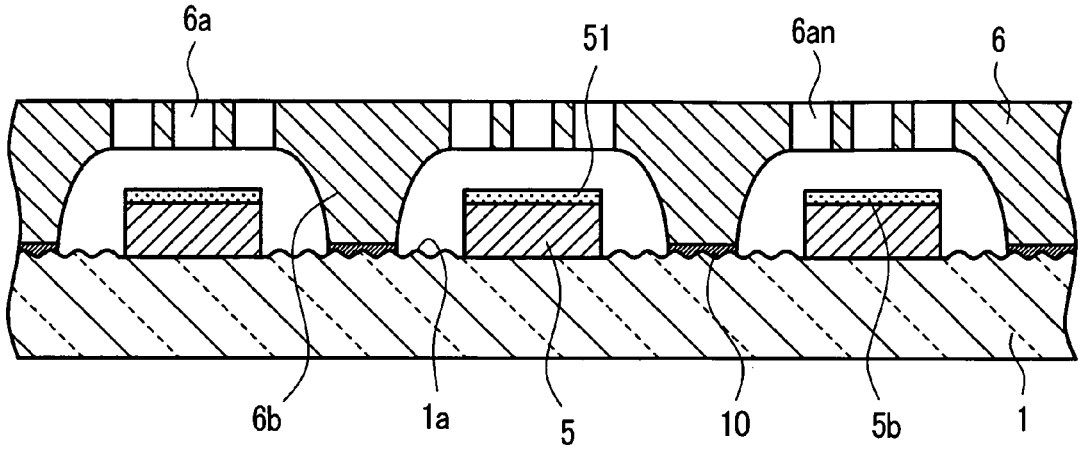
FIG. 7 is a schematic cross-sectional view further showing an essential part of another embodiment of the display device according to the present invention in an enlarged form.

FIG. 7 is a schematic cross-sectional view showing a representative part of another embodiment of the display device according to the present invention in an enlarged form. In the drawing, the same numerals as those used in FIG. 1 to FIG. 6 indicate identical functional portions. In FIG. 7, numeral 1*a* indicates an inner surface of a back substrate 1, and this inner surface 1*a* exhibits an uneven shape. That is, the uneven shape is formed by removing portions of the glass component on the surface simultaneously when the chemical etching treatment is applied to the glass component in the connecting portion 5*b* of the cathode line 5, as explained in conjunction with FIG. 5. In this manner, by forming the uneven shape on the inner surface 1*a* of the back substrate 1, in addition to the advantageous effect explained in conjunction with FIG. 5, it is possible to increase the mutual creeping distance between the neighboring electrodes, whereby an enhancement of the dielectric strength can be achieved.

Here, it is needless to say that the uneven shape may be formed before applying the cathode lines 5 on the inner surface 1*a* of the back substrate 1, or it may be formed by a known processing method other than chemical etching.

Further, by preliminarily forming the whole surface of the inner surface 1*a* of the back substrate 1 into an uneven shape and, thereafter, by forming the cathode lines 5 and the like, it is possible to obtain an advantageous effect in that the adhesive strength for adhering the inner surface 1*a* of the back substrate 1 with the electrodes to be mounted on the inner surface 1*a* can be further enhanced.

Figure 8:
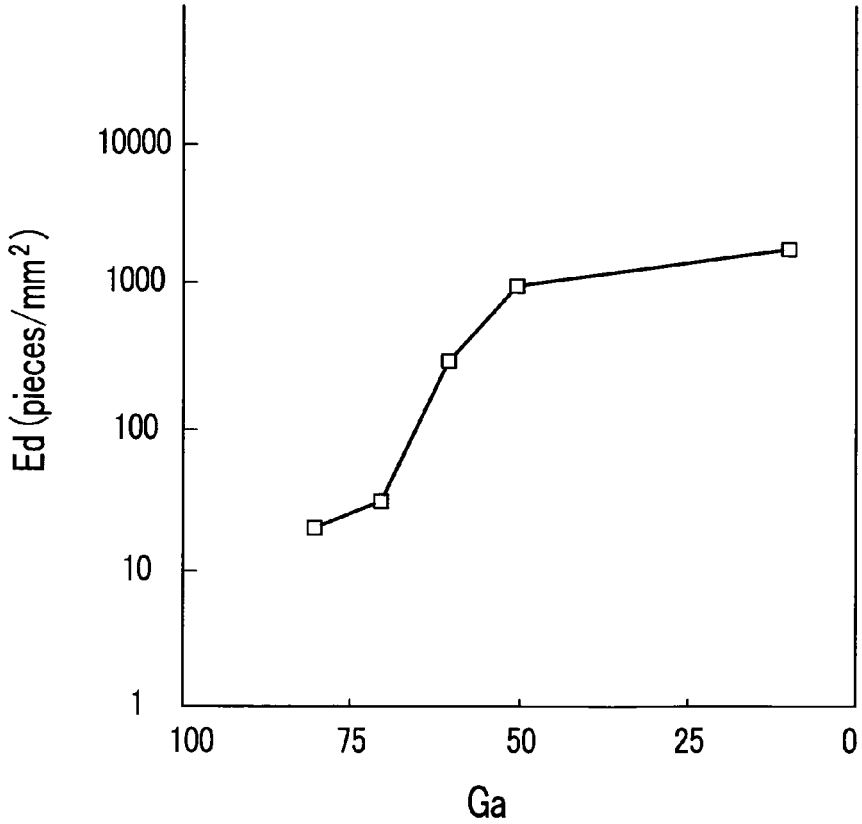
FIG. 8 is a graph showing the relationship between the property and the light emitting uniformity of a connecting portion of a cathode line as it relates to the present invention.

FIG. 8 is a graph showing the relationship between the property and the light emitting uniformity of the connecting portion of the cathode line of one embodiment of the display device according to the present invention. In the drawing, the a glass occupancy rate (area ratio) Ga (%) in the composition of the connecting portion of the cathode line is taken on an axis of abscissas and the electron emission site density Ed (pieces/$mm^2$), which becomes an index of the light emission uniformity, is taken on an axis of ordinates.

In FIG. 8, first of all, the cathode lines are formed using the above-mentioned silver paste which is usually used, that is, a silver paste which contains silver particles and the low melting-temperature glass is formed. The glass occupancy rate (area ratio) Ga (%) of the connecting portion of the cathode line is 80%. Subsequently, the glass component is gradually expelled from the surface which constitutes the connecting portion of the cathode line with the electron source, and, then, an electron source is formed on the surface. Thereafter, the electron emission site density Ed with respect to the glass occupancy rate Ga is measured. The expulsion of the glass component is performed by the removal of silver oxide on the surface of the silver particles in a lift-off manner.

Figure 9:
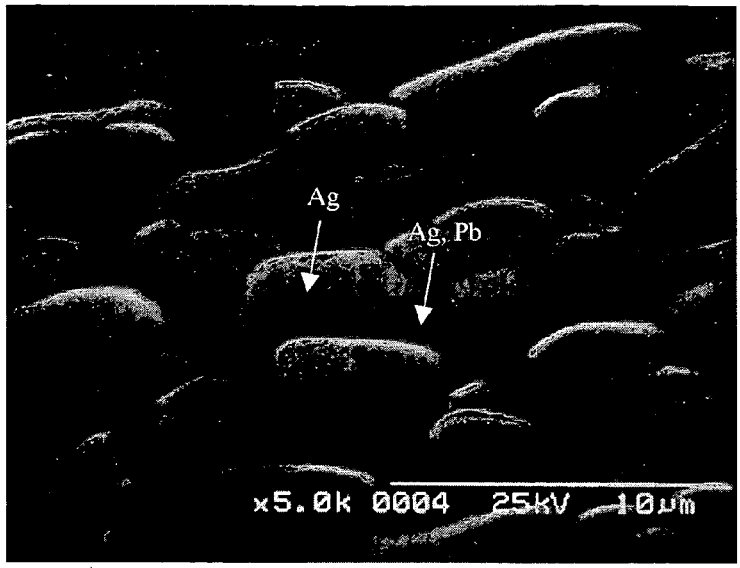
FIG. 9 is a SEM photograph showing a surface of the cathode line as it relates to the present invention.
Figure 10:
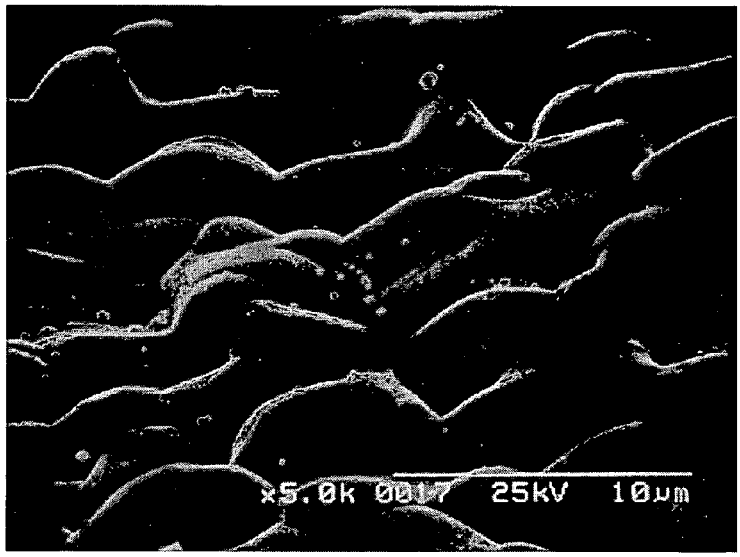
FIG. 10 is a SEM photograph showing a surface of one example of the cathode line used in the display device of the present invention.

That is, the surface of the cathode line which is formed by printing and baking the silver paste has, as indicated in the SEM photograph shown in FIG. 9, a constitution in which the melted glass surrounds the peripheries of silver particles or lead particles in the low melting-temperature glass. The cathode line having such a surface condition is treated in a lift-off manner as described above to expel the glass component using thiourea system chemicals (for example, ESCREEN AG-301, a product of Sasaki Kagaku Yakuhin Kabushiki Kaisha). FIG. 10 is a SEM photograph showing the surface of the cathode line after the treatment. As can be understood from the SEM photograph, in the surface which constitutes the connecting portion, only the glass component between the silver particles is removed.

Next, the measurement of the electron emission site density is performed by an emission profiler having minute apertures in a measuring anode (for example, a product of Tokyo Cathode Ltd.) under conditions where the aperture diameter is set to 10 μm, the distance between the anode and an electron source is set to 50 μm, and the measuring step is set to 10 μm. As can be understood from FIG. 8, it was found that when the glass occupancy rate Ga is lowered to a value below 50% as a result of the gradual expulsion of the glass component from the surface which constitutes the connecting portion 5*b* of the cathode line 5 with the electron source 51, the light emitting brightness can obtain a practically sufficient electron emission site density. Although the electron emission site density rapidly changes when the glass occupancy rate is in a range of 70% to 50%, there exists a possibility that the light emitting brightness will become insufficient when the glass occupancy rate is 60%. Accordingly, it is important from a practical point of view that the glass occupancy rate is below 50%.

On the other hand, when the glass occupancy rate is 50% or below, as shown in the drawing, it is possible to ensure a sufficient electron emission site density. However, even when the glass occupancy rate of 50% is lowered to approximately 10%, the difference in the electron emission site density between the case in which the glass occupancy rate is 50% and the case in which the glass occupancy rate is 10% is extremely small, and, hence, the glass occupancy rate may be determined based on the balance between a treatment operation amount for expelling the glass component and the electron emission site density.

Figure 11:
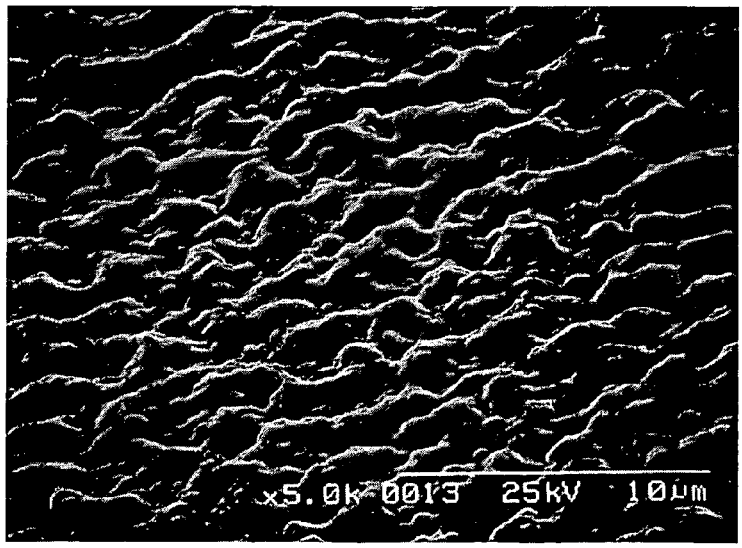
FIG. 11 is a SEM photograph showing a surface of another example of the cathode line used in the display device of the present invention.

FIG. 11 is a SEM photograph showing a surface of the conductor layer 52 which is interposed between the cathode line 50 and the electron source 51 having the constitution shown in FIG. 6 and which has the whole thereof formed of only fine silver particles. To compare the surface state indicated in FIG. 11 and the previously-mentioned surface state indicated in FIG. 9, the difference is evident. That is, it is possible to confirm with the naked eye that the surface of the conductor layer 52 is covered with a silver film which hardly contains the glass component. Accordingly, by merely applying the electron source 51, such as carbon nanotubes, for example, to the cathode line without affording any treatment to the surface of the conductor layer 52, a substantially uniform electron emission can be produced from the whole surface of the electron sources, and, hence, a desired display is obtained.

Figure 12:
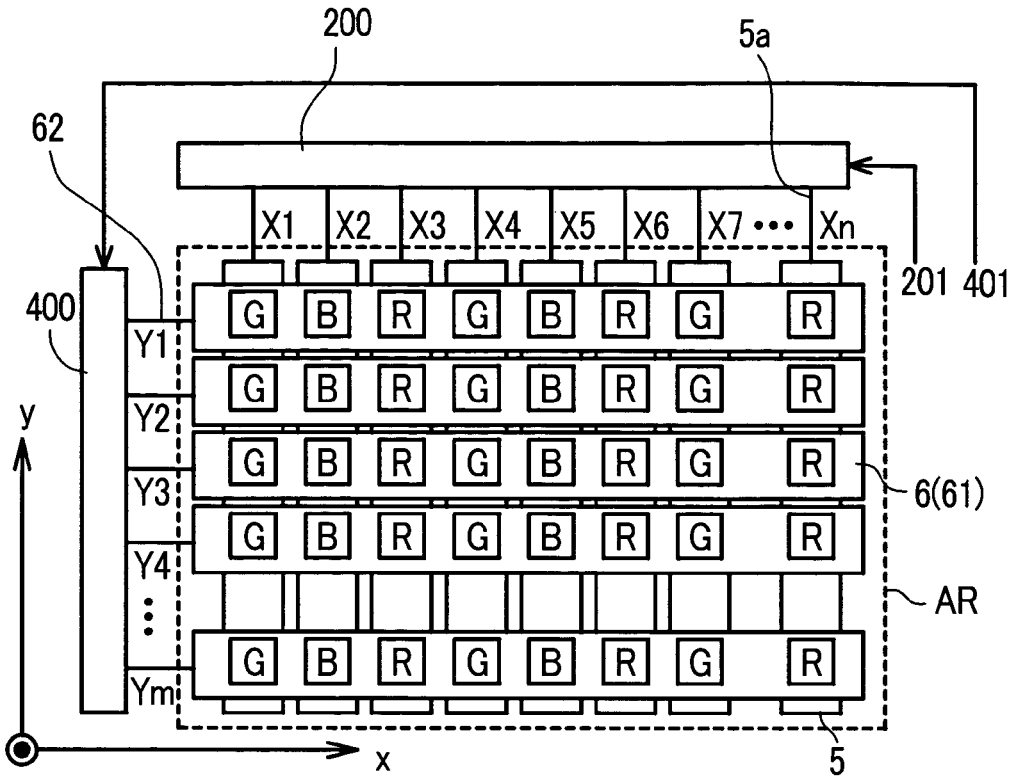
FIG. 12 is a diagram showing an example of an equivalent circuit of the display device according to the present invention.
Figure 13:
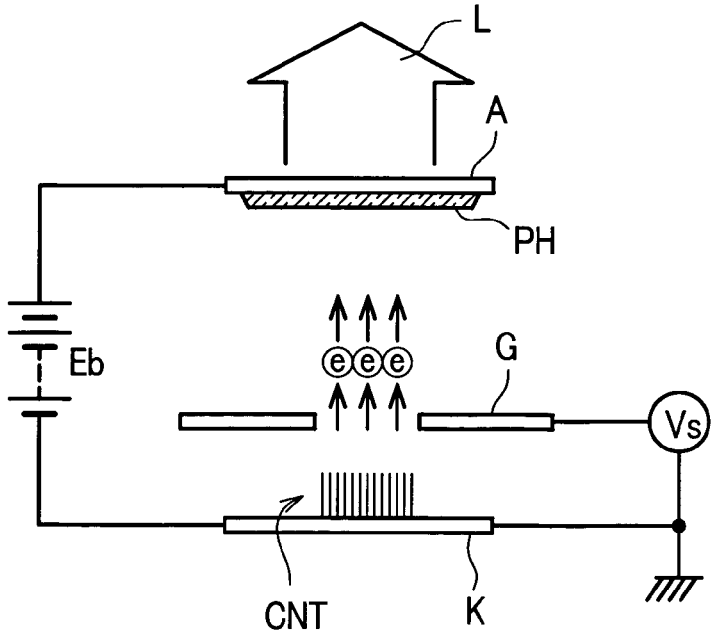
FIG. 13 is a schematic diagram showing the basic constitution of a field emission type display.
Figure 14:
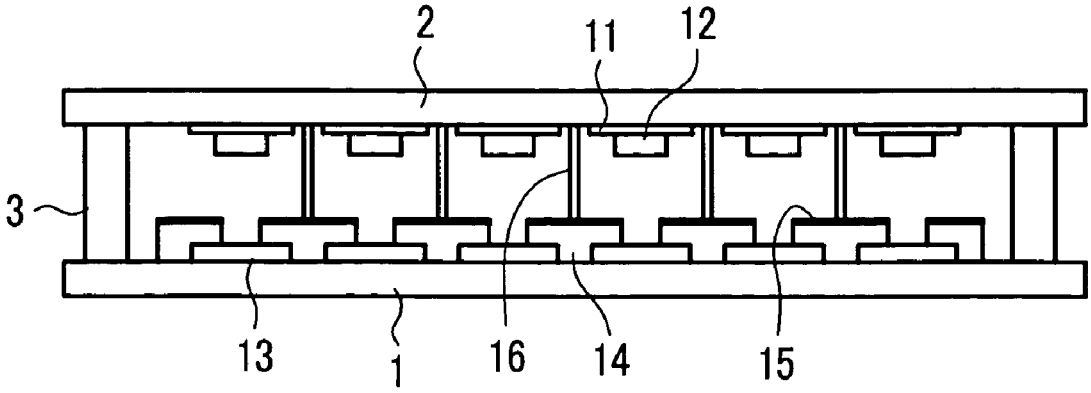
FIG. 14 is a schematic cross-sectional view showing a constitutional example of a field emission type display.
Figure 15:
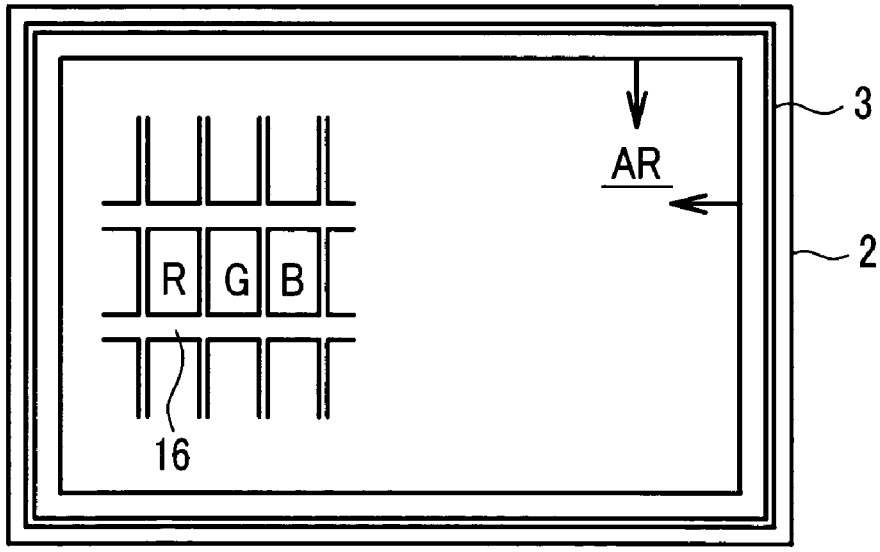
FIG. 15 is a schematic plan view of a field emission type display as shown in FIG. 14.

FIG. 12 is an equivalent circuit diagram of the display device of the present invention. The region indicated by a broken line in the drawing indicates a display region AR. In the display region AR, the cathode lines 5 and the control electrodes 6 (strip-like electrode elements 61) are arranged to cross each other thus forming a matrix of n×m lines. Respective crossing portions of the matrix constitute unit pixels, and one color pixel is constituted of a group of "R", "G", "B" unit pixels in the drawing. The cathode lines 5 are connected to a video drive circuit 200 through the cathode line lead lines 5*a* (X1, X2, . . . Xn), while the control electrodes 6 are connected to a scanning drive circuit 400 through control electrode lead lines 62 (Y1, Y2, . . . Ym). The video signals 201 are inputted to the video drive circuit 200 from an external signal source, while scanning signals (synchronous signals) 401 are inputted to the scanning drive circuit 400 in the same manner.

Accordingly, the pixels which are sequentially selected by the strip-like electrode elements 61 and the cathode lines 5 are illuminated with lights of given colors so as to display a two-dimensional image. With the provision of the display device having such a constitution, for example, it is possible to realize a flat panel type display device which is operated by a relatively low voltage and, hence, exhibits a high efficiency.

As has been explained heretofore, by constituting the connecting portion of the cathode line with the electron source such that the conductor occupancy rate becomes equal to or more than the insulator occupancy rate, electron emission from the whole surface of the electron source can be produced and, at the same time, a uniform emission quantity can be obtained for a long time, whereby it is possible to provide a display device which can produce a high quality display and which has a long lifetime.

Further, by interposing the layer in which the conductor exhibits a high occupancy rate in the connecting portion between the cathode line and the electron source, electron emission from the whole surface of the electron source can be produced, and, at the same time, a uniform emission quantity can be obtained for a long time. Further, the adhesive strength between the back substrate and the cathode line can be sufficiently ensured, whereby it is possible to provide a display device which is capable of exhibiting a high quality display and which has a long lifetime.

What is claimed is:

1. A display device comprising:

a face substrate having anodes and phosphors formed on an inner surface thereof;

a plurality of cathode lines which extend in one direction and are arranged in parallel in another direction which crosses the one direction;

a plurality of electron sources which are arranged on the cathode lines in an electrically conductive manner;

control electrodes which face the cathode lines in a display region and have electron passing apertures for allowing electrons from the electron sources to pass through the electron passing apertures to the face substrate side;

a back substrate having the control electrodes and the cathode lines formed on an inner surface thereof and which faces the face substrate in an opposed manner with a given distance therebetween;

a support body which is interposed between the face substrate and the back substrate in a state such that the support body surrounds a display region and holds said given distance; and a sealing material which hermetically seals end faces of the support body and the face substrate, and the back substrate respectively, wherein a connecting portion of the cathode line with the electron source has a composition which includes a conductor and an insulator, and the composition is determined such that the occupancy rate of the conductor is set to be equal to or more than the occupancy rate of the insulator.

2. A display device according to claim 1, wherein the occupancy rate of the insulator is less than 50%.

3. A display device according to claim 1, wherein a surface of the back substrate in the vicinity of the cathode lines exhibits an uneven shape.

4. A display device according to claim 1, wherein the connecting portion of the cathode line with the electron source is interposed between the cathode line and the electron source and has a composition which differs from a composition of the cathode line in relation to the occupancy rate of the conductor with respect to the occupancy rate of the insulator.

5. A display device according to claim 1, wherein the cathode lines have a composition which includes a conductor and an insulator, and the connection portion of the cathode line with the electron source has a composition which differs from the composition of the cathode line in relation to the occupancy rate of the conductor with respect to the occupancy rate of the insulator.

6. A display device according to claim 1, wherein the connecting portion of the cathode line with the electron source enables electron emission to be produced from substantially the whole surface of the electron source with a uniform emission quantity for a long time.

7. A display device comprising:

a face substrate having anodes and phosphors formed on an inner surface thereof;

a plurality of cathode lines which extend in one direction and are arranged in parallel in another direction which crosses the one direction;

a plurality of electron sources which are arranged on the cathode lines in an electrically conductive manner;

control electrodes which face the cathode lines in a display region and have electron passing apertures for allowing electrons from the electron sources to pass through the electron passing apertures to the face substrate side;

a back substrate having the control electrodes and the cathode lines formed on an inner surface thereof and which faces the face substrate in an opposed manner with a given distance therebetween;

a support body which is interposed between the face substrate and the back substrate in a state such that the support body surrounds a display region and holds said given distance; and a sealing material which hermetically seals end faces of the support body and the face substrate and the back substrate, respectively, wherein a layer having a conductor is interposed in a connecting portion between the cathode line and the electron source;

wherein the cathode line is formed of a composition in which a conductor has a predetermined occupancy rate, and the layer which is interposed in the connecting portion between the cathode line and the electron source has a different occupancy rate of the conductor with respect to the predetermined occupancy rate of the conductor for the cathode line; and wherein the occupancy rate of the conductor of the layer interposed in the connecting portion between the cathode line and the electron source is higher than the predetermined occupancy rate of the conductor of the cathode line.

8. A display device according to claim 7, wherein the layer in which the occupancy rate of the conductor is higher than the predetermined occupancy rate of the conductor of the cathode line is either a silver particle layer or a gold particle layer.

9. A display device according to claim 8, wherein the layer which is interposed in the connecting portion between the cathode line and the electron source enables electron emission to be produced from substantially the whole surface of the electron source with a uniform emission quantity to be obtained for a long time.

10. A display device according to claim 7, wherein the layer is a member which is separate from the cathode line and the electron source.

11. A display device according to claim 7, wherein the layer which is interposed in the connecting portion between the cathode line and the electron source is a member which is separate from the cathode line and the electron source, and has a composition which differs from the composition of the cathode line at least in relation to the occupancy rate of a conductor of the cathode line.

12. A display device according to claim 7, wherein the layer which is interposed in the connecting portion between the cathode line and the electron source enables electron emission to be produced from substantially the whole surface of the electron source with a uniform emission quantity to be obtained for a long time.

13. A display device comprising:

a face substrate having anodes and phosphors formed on an inner surface thereof;

a plurality of cathode lines which extend in one direction and are arranged in parallel in another direction which crosses the one direction, the cathode lines including a conductor and an insulator with the conductor having a first occupancy rate with respect to an occupancy rate of the insulator;

a plurality of electron sources which are electrically connected with the cathode lines;

a back substrate having the electron sources and the cathode lines formed on an inner surface thereof and which faces the face substrate in an opposed manner with a given distance therebetween;

a support body which is interposed between the face substrate and the back substrate in a state such that the support body surrounds a display region and holds said given distance;

a sealing material which hermetically seals end faces of the support body and the face substrate, and the back substrate respectively; and a connection portion interposed between the cathode line and the electron source for enabling electrical connection therebetween;

wherein the connection portion has a conductor with a second occupancy rate which is different from the first occupancy rate of the conductor of the cathode line; and wherein the second occupancy rate of the conductor of the connection portion is higher than the first occupancy rate of the conductor of the cathode line.

14. A display device according to claim 13, wherein the connection portion is a separate layer disposed between the cathode line and the electron source.

15. A display device according to claim 13, wherein the connection portion is formed as a part of the cathode line at an upper surface of the cathode line and has a different composition from a composition of the cathode line at least with respect to the occupancy rate of the conductor.

* * * * *